US011220818B2

(12) United States Patent
Hobeyn

(10) Patent No.: US 11,220,818 B2
(45) Date of Patent: Jan. 11, 2022

(54) ADAPTABLE PANEL MOUNTING SYSTEM

(71) Applicant: Fred Hobeyn, Aldergrove (CA)

(72) Inventor: Fred Hobeyn, Aldergrove (CA)

( * ) Notice: Subject to any disclaimer, the term of this patent is extended or adjusted under 35 U.S.C. 154(b) by 0 days.

(21) Appl. No.: 17/026,958

(22) Filed: Sep. 21, 2020

(65) Prior Publication Data

US 2021/0002893 A1 Jan. 7, 2021

Related U.S. Application Data

(63) Continuation of application No. 16/394,941, filed on Apr. 25, 2019, now abandoned, which is a continuation of application No. 14/377,157, filed as application No. PCT/CA2013/000120 on Feb. 12, 2013, now abandoned.

(60) Provisional application No. 61/597,801, filed on Feb. 12, 2012.

(51) Int. Cl.

| | |
|---|---|
| ***E04B 2/74*** | (2006.01) |
| ***E04F 11/18*** | (2006.01) |
| ***E04B 2/72*** | (2006.01) |
| ***E04B 2/76*** | (2006.01) |
| ***E04C 2/54*** | (2006.01) |

(52) U.S. Cl.

CPC ..... *E04B 2/7407* (2013.01); *E04B 2/72* (2013.01); *E04B 2/7416* (2013.01); *E04B 2/7435* (2013.01); *E04B 2/7438* (2013.01); *E04B 2/76* (2013.01); *E04C 2/54* (2013.01); *E04F 11/1812* (2013.01); *E04F 11/1834* (2013.01); *E04F 11/1853* (2013.01); *E04B 2002/7496* (2013.01); *E04F 2011/1831* (2013.01); *E04F 2011/1889* (2013.01)

(58) Field of Classification Search

CPC .... E04B 2/7407; E04B 2/7416; E04B 2/7438; E04B 2/744; E04B 2002/7446; E04H 17/168

USPC ..... 52/64, 65, 71

See application file for complete search history.

(56) References Cited

U.S. PATENT DOCUMENTS 1,818,404 A * 8/1931 Kaufman ..... A47F 5/005 312/140
2,576,384 A * 11/1951 Bentley ..... E04H 15/003 160/135
2,723,107 A * 11/1955 Parker ..... E04H 17/20 256/24
3,111,206 A * 11/1963 Borup ..... F16B 5/08 52/282.1
3,190,408 A * 6/1965 Petterson ..... E04B 2/60 52/482
3,362,739 A * 1/1968 Staeger ..... E04B 1/34384 52/285.1

(Continued)

*Primary Examiner* — Adriana Figueroa
(74) *Attorney, Agent, or Firm* — Stephen R. Burri

(57) ABSTRACT

A panel mounting system for mounting a linear panel structure on a surface, having a plurality of posts, each having a base plate with mounting surfaces for surface attachment and a vertical extension having a lateral support beam perpendicular to a panel-receiving cross beam; first and second opposing semi-circular channels within first and second ends of the panel-receiving cross beam, wherein each channel forms a channel angle of 45 to 135 degrees relative to the lateral support beam; a hollow, circular cylindrical insert insertable into each channel; and a panel mountable between each pair of adjacent posts, each end of the panel insertable into a corresponding insert.

9 Claims, 8 Drawing Sheets

(56) References Cited

U.S. PATENT DOCUMENTS

| | | | | | |
|---|---|---|---|---|---|
| 3,659,389 | A * | 5/1972 | Forberg | G09F 15/0068 | 52/285.3 |
| 4,120,130 | A * | 10/1978 | Puschkarski | E04B 1/6112 | 52/282.5 |
| D315,215 | S * | 3/1991 | Schnebly | D25/119 | |
| 5,487,690 | A * | 1/1996 | Stoffle | A63H 33/10 | 16/225 |
| 5,592,787 | A * | 1/1997 | Ophardt | E04H 1/1266 | 52/239 |
| 5,647,181 | A * | 7/1997 | Hunts | A63H 33/10 | 312/111 |
| 6,546,675 | B1 * | 4/2003 | Adderton | E04B 2/7435 | 52/71 |
| 6,622,434 | B1 * | 9/2003 | Garrett | A63C 19/10 | 256/24 |
| 8,753,162 | B2 * | 6/2014 | Jensen | A63H 33/101 | 446/85 |
| 8,858,348 | B2 * | 10/2014 | Riley | A63C 19/10 | 472/92 |
| 2006/0186391 | A1 * | 8/2006 | Hansen | E06B 3/5454 | 256/24 |
| 2010/0071276 | A1 * | 3/2010 | Whittle | E04B 2/7442 | 52/71 |

* cited by examiner

ADAPTABLE PANEL MOUNTING SYSTEM

This application is a continuation of co-pending U.S. Utility patent application Ser. No. 16/394,941 filed Apr. 25, 2019, which is a continuation of U.S. Utility patent application Ser. No. 14/377,157 filed Aug. 6, 2014.

FIELD OF THE INVENTION

This invention relates to wall structure construction. In particular, the invention relates to a panel mounting system for mounting a linear panel structure on a surface. A panel mounting system of this type is disclosed in U.S. Pat. No. 3,962,827.

SUMMARY OF THE INVENTION

There is provided a panel mounting system for mounting a linear panel structure on a surface, the system comprising a plurality of posts, each post having a base plate with one or more mounting surfaces for surface attachment and a vertical extension, the vertical extension having a lateral support beam perpendicular to a panel-receiving cross beam; first and second opposing semi-circular channels within first and second ends of the panel-receiving cross beam, wherein each channel forms a channel angle of between 45 degrees and 135 degrees relative to the lateral support beam; a hollow, circular cylindrical insert insertable into each channel; and a panel mountable between each pair of adjacent posts, each end of the panel insertable into a corresponding insert.

The channel angle may be 45, 90, or 135 degrees. Each panel may be rotatable about a vertical axis at each end through a panel angle of 30 degrees to either side of the channel angle of the corresponding channels.

There may be a semi-circular wedge insertable at the top end of each semi-circular channel for securing the panel in a desired panel angle position, and a setting block insertable in the lower end of each channel for supporting the corresponding panel a desired distance above the surface. One or more wall tracks may be mountable on a vertical surface, each wall track having a semi-circular channel at an angle of between 45 degrees and 135 degrees relative to the vertical surface.

The one or more mounting surfaces of the base plate may be perpendicular to the longitudinal axis of the vertical extension, parallel to the longitudinal axis of the vertical extension, or at a selected angle relative to the longitudinal axis of the vertical extension, the selected angle corresponding to the slope of the mounting surface.

Each of the panels may be manufactured of tempered glass. The posts, inserts, wedges, and setting blocks may be manufactured of aluminum.

Each channel opening may be adapted to receive a panel having a thickness of 10 mm, or a panel having a thickness of 12 mm. In one embodiment, the post may be comprised of a separate base plate connectable to a vertical member.

The panel mounting system may be used as a room divider system, as a railing system, or as any other similar wall or barrier system.

Figure 1:
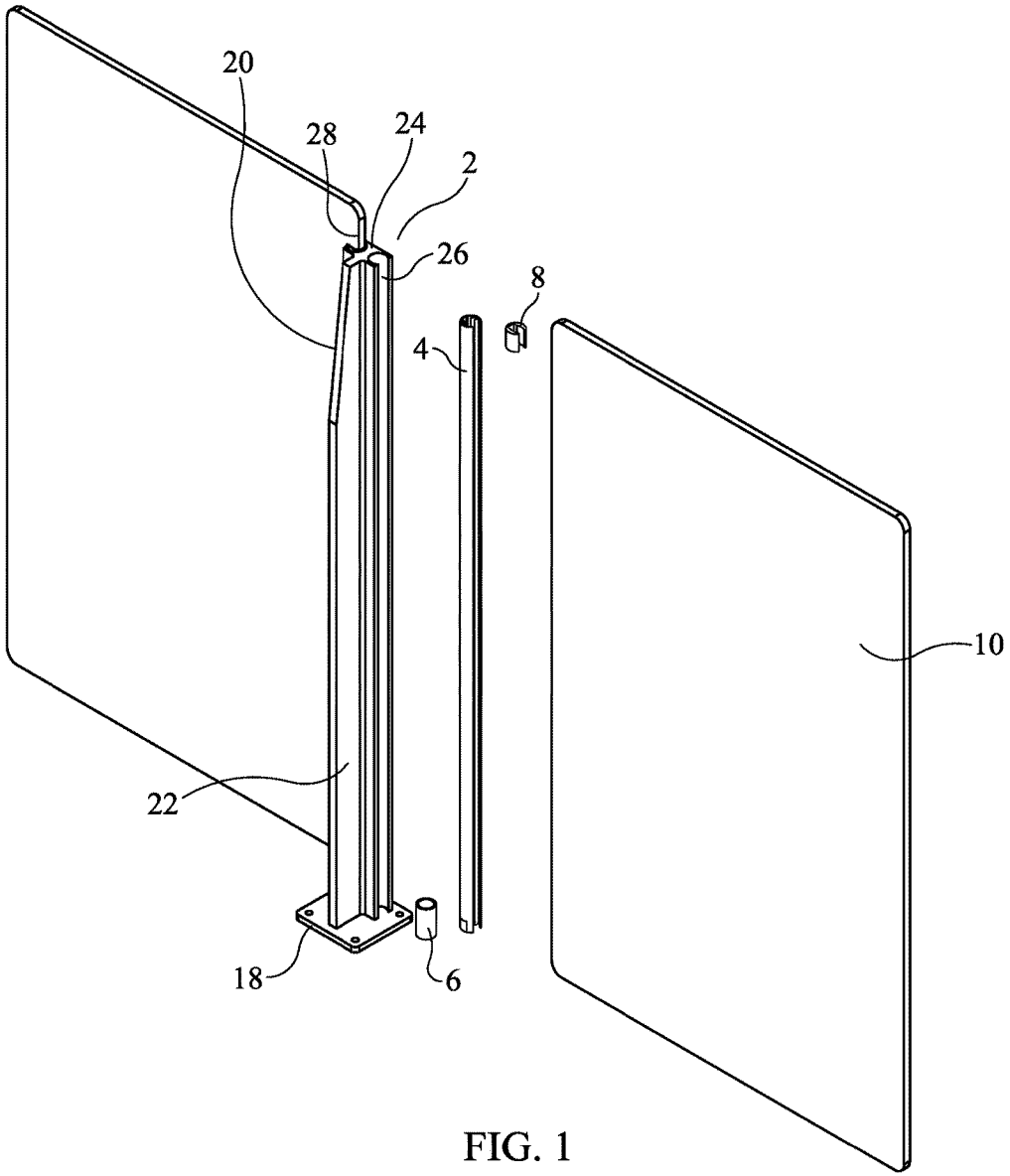
FIG. 1 shows the components of a surface mountable embodiment of an adaptable panel mounting system, according to the invention.

In the description which follows like parts are marked throughout the specification and in the drawings with the same respective reference numbers. Drawings are not necessarily to scale and in some instances proportions may have been exaggerated in order to more clearly depict certain features of this invention.

DETAILED DESCRIPTION OF THE INVENTION

There is provided an adaptable panel mounting system. The system of the present invention may be used to provide railings for balconies, patios, stairways, and other applications. In alternate embodiments of the invention, the panel mounting system may be used to provide room dividers or similar wall-like structures.

The panel mounting system of the present invention comprises a plurality of posts 2 of varying designs, inserts 4, setting blocks 6, wedges 8, and panels 10. In a preferred embodiment, three types of post are provided, namely, mid-posts 12, inside posts 14, and outside posts 16.

As shown in FIG. 1, each mid-post is a unitary structure comprised of a base plate 18 and a vertical extension 20. The mid-post vertical extension has a generally T-shaped transverse cross-section comprising a lateral support beam 22 perpendicular to a panel receiving cross-beam 24. The opposing ends of the crossbeam comprise a pair of opposing semi-circular channels 26, 28 having an open end for receiving an insert 4. For the mid-post, a line extending from the base of the trough of each channel through the centre of the opening of the channel will be perpendicular to a line through the lateral support beam.

A hollow, circular panel receptacle, termed herein an "insert", having an open channel extending along its entire length, is reversibly attachable by insertion of the end of a flat panel into the channel. The panel and attached insert are insertable into the channels of the mid-post. A setting block 6 may be inserted into the channel prior to insertion of the insert if the panel is to be elevated above the mounting surface 32. A wedge 8 may be inserted into the channel after insertion of the insert to lock the panel in place and prevent ingress of water and debris into the channel.

Figure 2A:
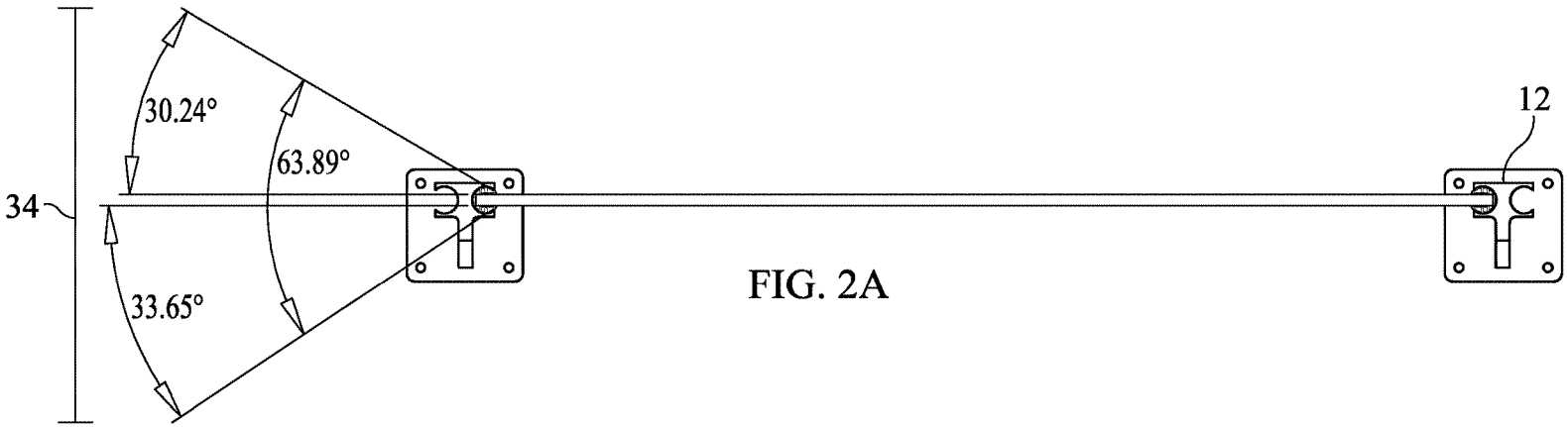
FIG. 2A demonstrates an angle range of 63.89 degrees achievable at one end of a panel with one embodiment of the various post types of the invention.
Figure 2B:
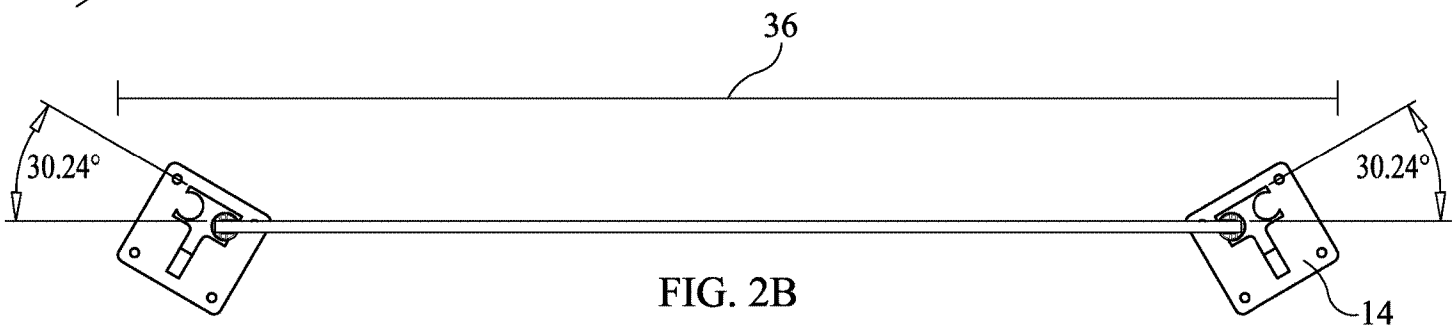
FIG. 2B demonstrates an angle range of 30.24 degrees achievable at each end of a first side of a panel with a second embodiment of the various post types of the invention.
Figure 2C:
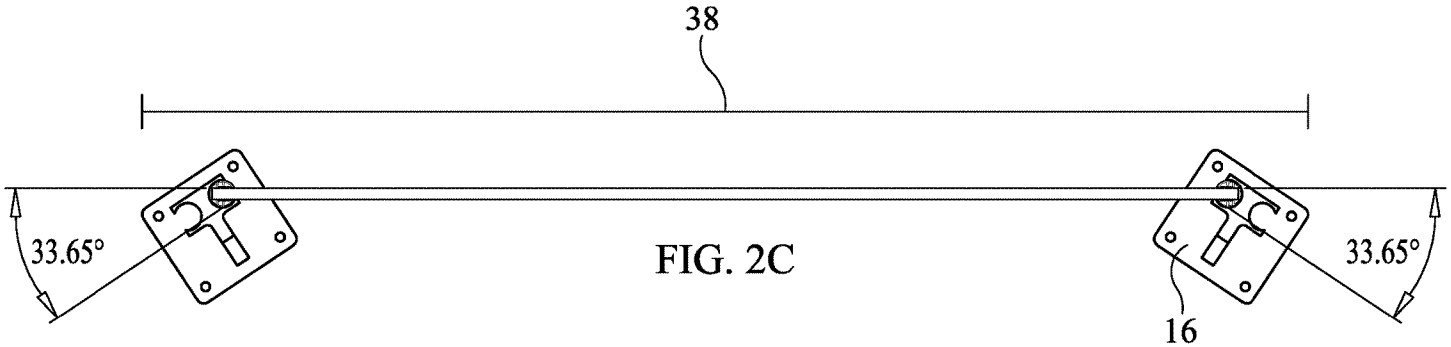
FIG. 2C demonstrates an angle range of 33.65 degrees achievable at each end of a second side of a panel with a second embodiment of the various post types of the invention.

The panel and insert may be rotated about the longitudinal axis of the insert within the channel of the mid-post along an arc between approximately 60 and approximately 120 degrees relative to the lateral support beam of the mid-post. For all types of post of the invention, inserted panels may be rotated along an arc 34 approximately 30 degrees to each side of the line extending from the base of the trough of the channel through the centre of the open end of the channel. FIG. 2 depicts several arrangements of a panel mounting section comprising a panel having mid-posts at each end, demonstrating the angular range available 34, 36, 38.

A second post type comprises an inside post 14. Each inside post includes a base plate and a vertical extension. The inside post vertical extension has a generally T-shaped transverse cross-section comprising a lateral support beam perpendicular to a panel receiving cross-beam. The opposing ends of the cross-beam comprise a pair of opposing semi-circular channels having an open end for receiving an insert. A line extending from the trough of each channel through the centre of the opening of the channel will form a 45-degree angle with a line through the lateral support beam.

A panel and attached insert are insertable into the channels of the inside post. The panel and insert may be rotated within the channel of the inside post along an arc between approximately 15 and approximately 75 degrees relative to the support beam of the inside post.

A third post type comprises an outside post 16. Each outside post includes a base plate and a vertical extension. The outside post vertical extension has a generally T-shaped transverse cross-section comprising a lateral support beam perpendicular to a panel receiving cross-beam. The opposing ends of the cross-beam comprise a pair of opposing semi-circular channels having an open end for receiving an insert. A line extending from the trough of each channel through the centre of the opening of the channel will form a 135-degree angle with a line through the lateral support beam.

A panel and attached insert are insertable into the channels of the outside post. The panel and glass insert may be rotated within the channel of the outside post along an arc between approximately 105 and approximately 165 degrees relative to the support beam of the outside post.

As will be noted, some of the angles possible for each post type will overlap with some of the angles possible with other post types, thereby allowing a degree of interchangeability of posts for certain angles.

Figure 3:
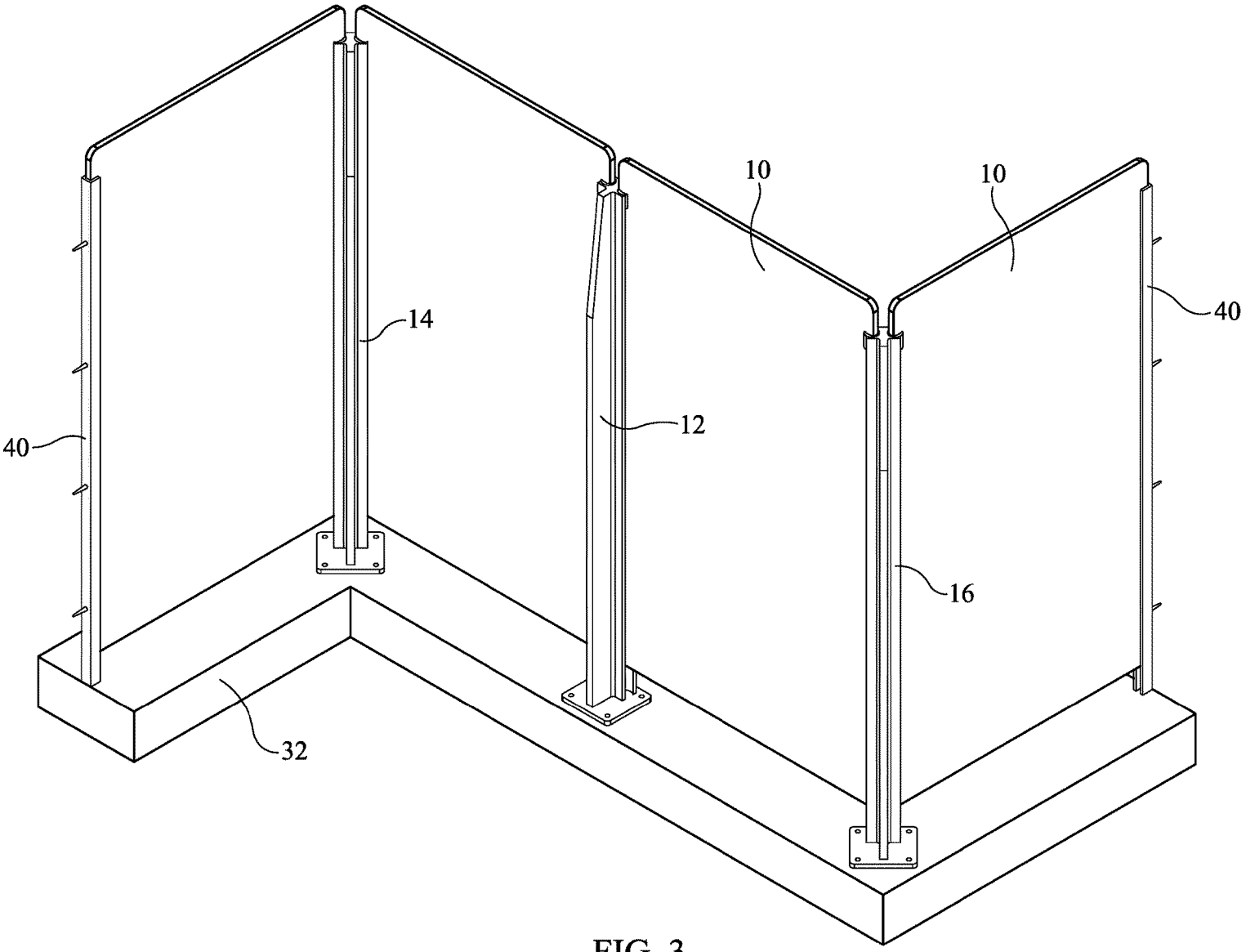
FIG. 3 is an isometric view of one embodiment of a surface mounted system, according to the invention.

FIG. 3 depicts an assembly of the components of the system of the present invention into a panel mounting structure. FIG. 3 depicts an additional component of the system, a wall track 40. The wall track comprises an elongated member having a first flat side for placement against a wall or other flat vertical surface, and an opposing second side having an open circular channel for receiving an insert and attached panel. Various attachment means may be used for attaching the wall track to a wall or similar surface, including screws or nails as depicted in FIG. 3, but other attachment means are also possible.

Figure 4:
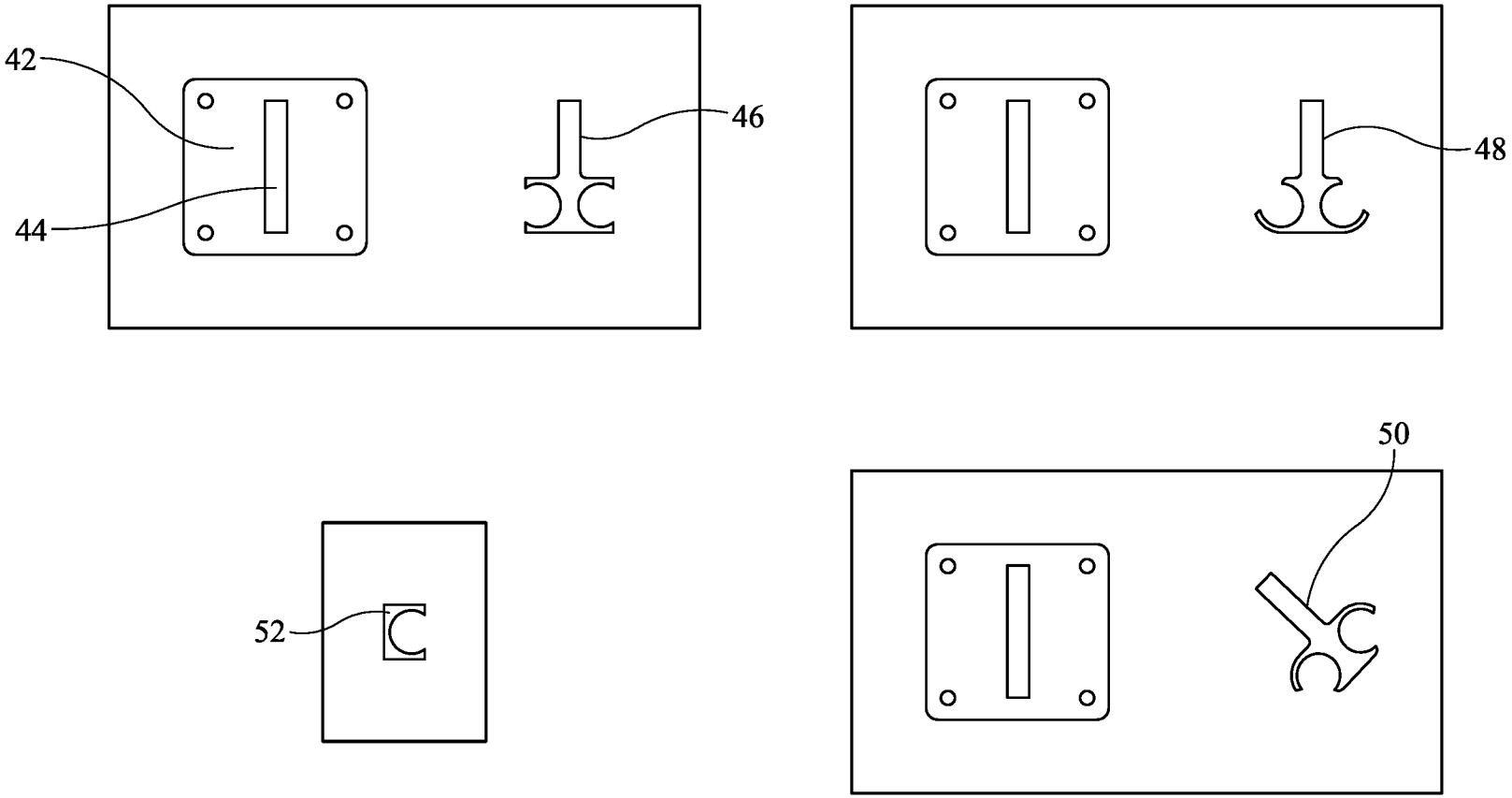
FIG. 4 shows cross-sectional views of the various base plates and post extrusions of the surface mounted embodiment of the invention, as well as the wall track of the invention.

As shown in FIG. 4, the base plate of each of the posts comprises a planar base 42 having an opening 44 for receiving the bottom of the vertical extension of the post. The base plate may be welded to the vertical extension. In a preferred embodiment, the welds are located on the lower side of the base plate, thereby not visible in the assembled panel mounting. A plurality of openings is also provided in the base plate for insertion therethrough of attachment means for attaching the base plate to the surface. FIG. 4 also shows transverse cross-sections of the mid-post 46, inside post 48 and outside post 50 vertical extensions, and a transverse cross section of a wall track 52.

Figure 5:
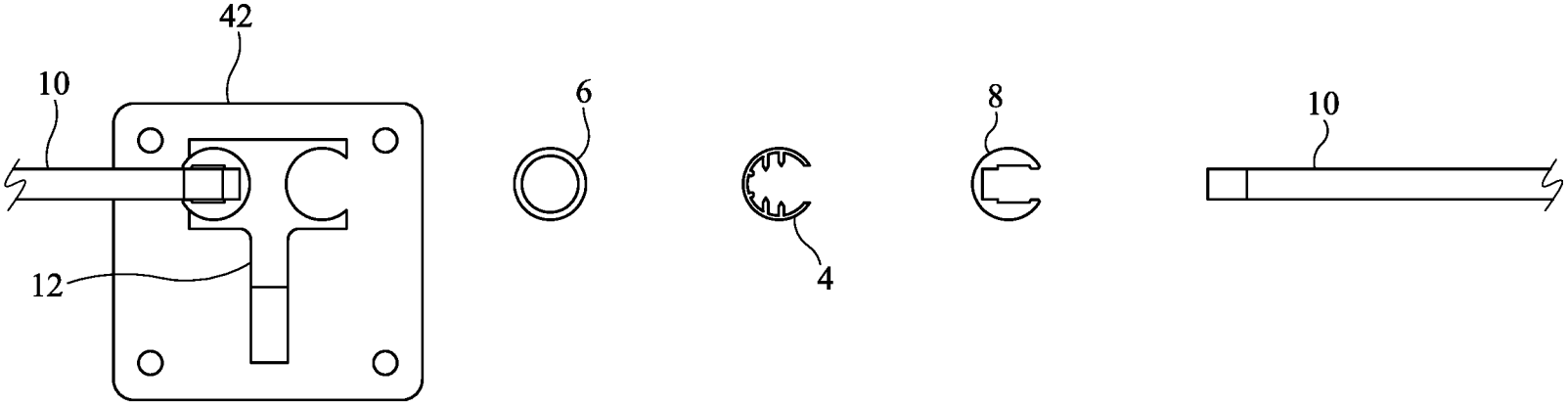
FIG. 5 is a top view of the components of the surface mounted embodiment of the invention.

The insert of the invention is adapted to receive standard industry panels having a thickness of 10 mm or 12 mm. Other panels of similar thickness may also be used with the inserts. The internal surface of the insert may include baffles or protrusions to increase the friction between the internal surface and an inserted panel. Detail of the components of the assembly is shown in FIG. 5.

In an alternate embodiment, the base plate may be non-perpendicular to the longitudinal axis of the vertical extension. In this embodiment, a base plate may be attached to a sloping surface yet still have a vertical extension extending therefrom.

Figure 6:
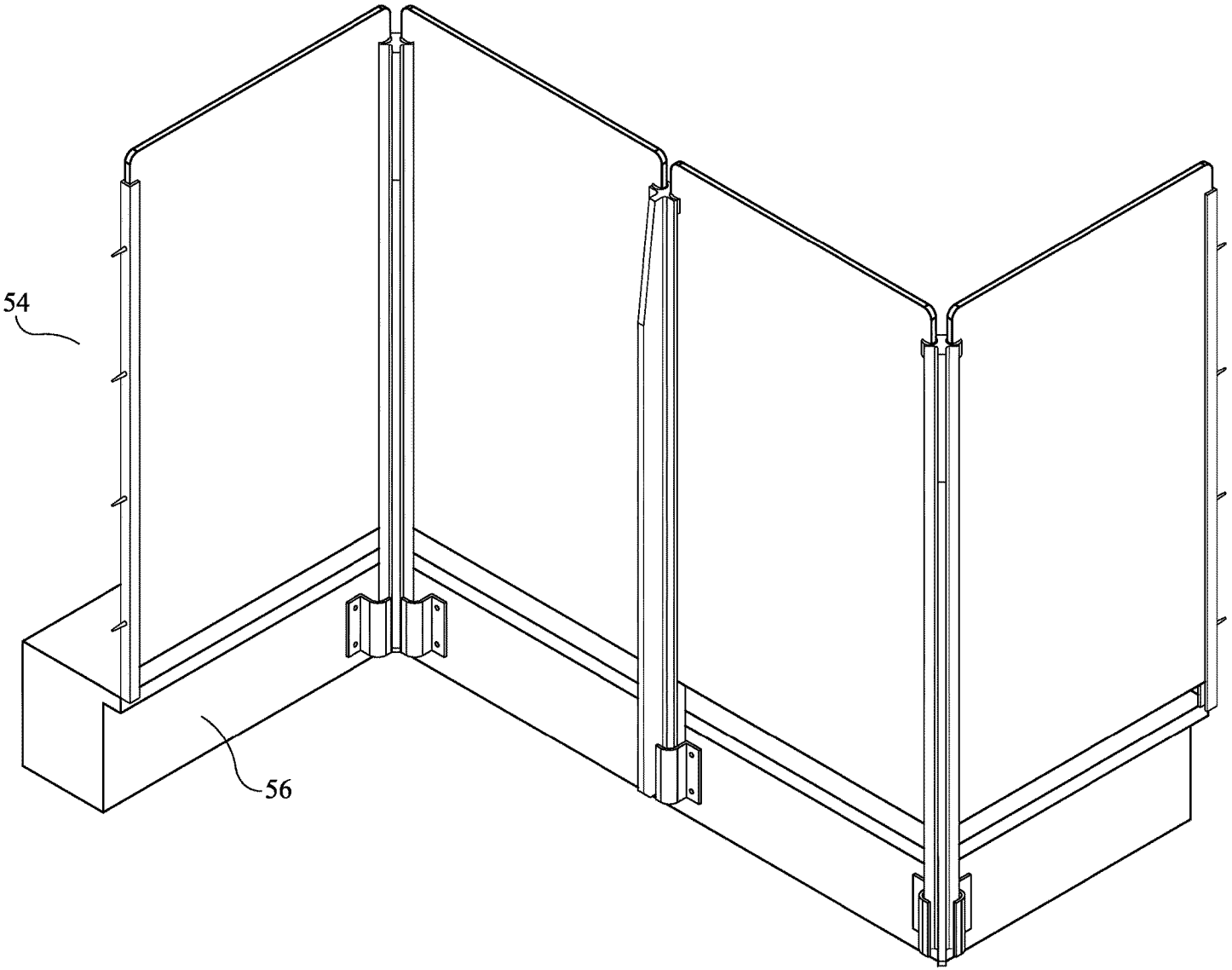
FIG. 6 is an isometric view of one embodiment of a fascia mounted system, according to the invention.

In another alternate embodiment for a fascia mounted system 54, the plane defined by the base plate may be parallel with the longitudinal axis of the vertical extension. In this embodiment, the base plate may be attached to a vertical surface 56. FIG. 6 depicts an isometric view of such a system.

Figure 7:
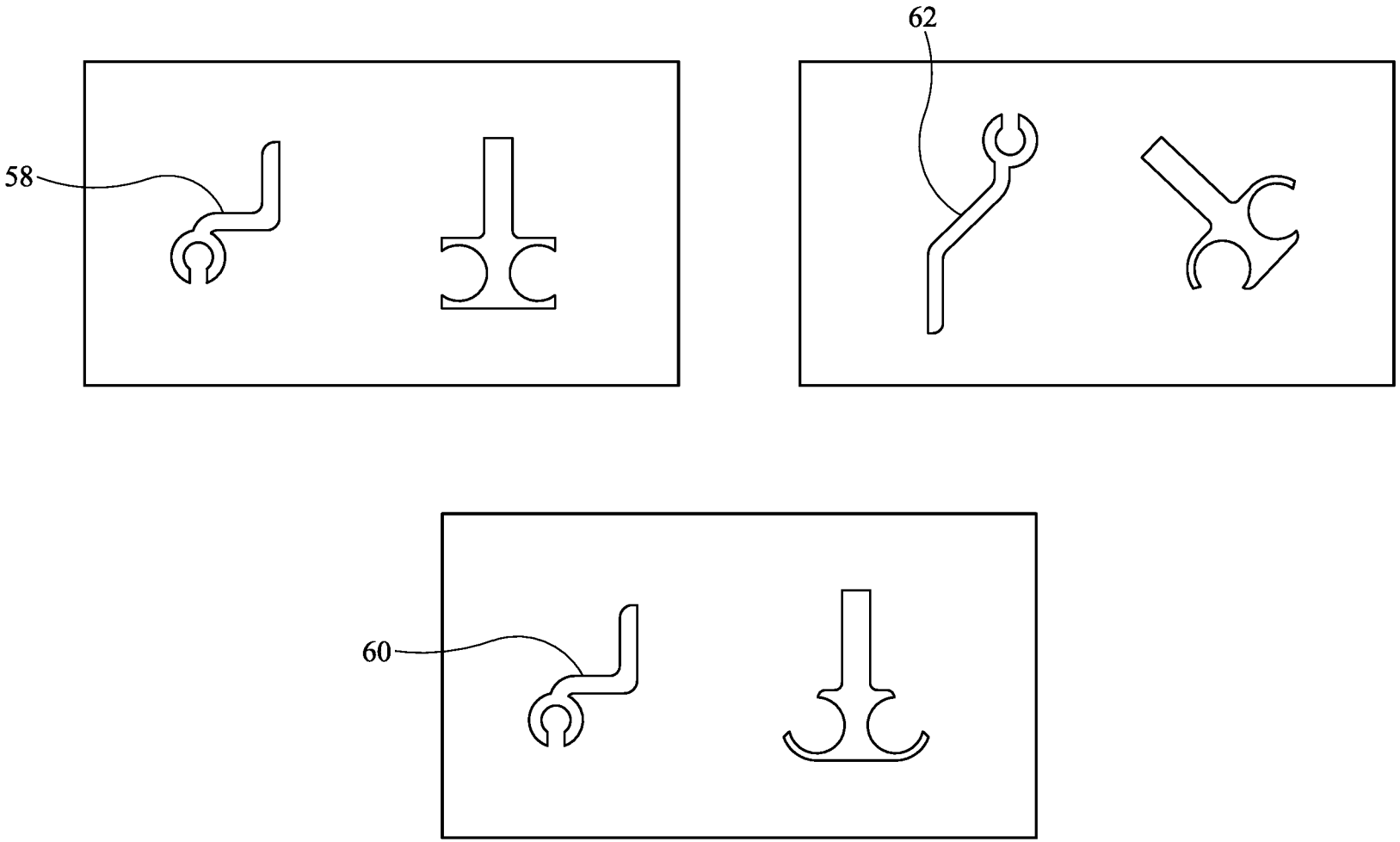
FIG. 7 shows cross-sectional views of the various base plates and post extrusions of the fascia mounted embodiment of the invention.
Figure 8:
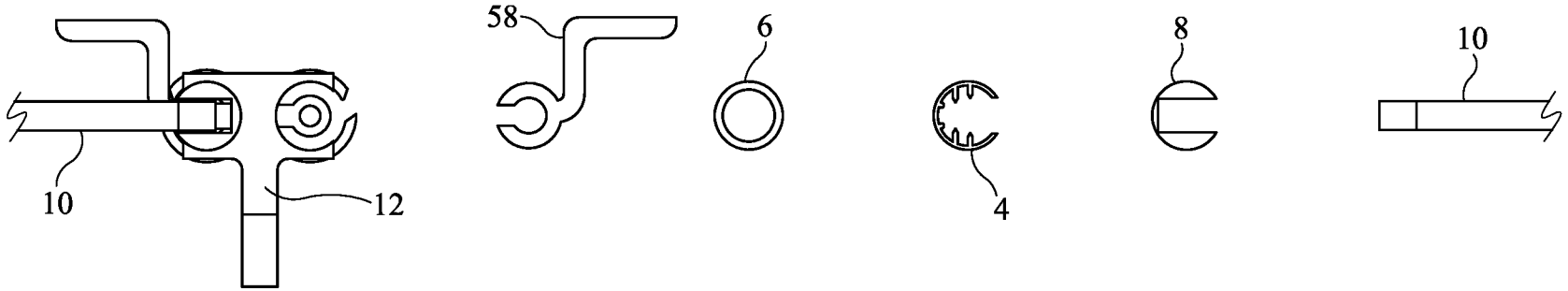
FIG. 8 is a top view of the components of the fascia mounted embodiment of the invention.

FIG. 7 depicts the transverse cross-sectional views of the mid-post, inside post and outside post base plates 58, 60, 62 for the fascia mounted system, as well as the corresponding cross-sections of the vertical extensions for the posts of the invention. Detail of the components of the fascia mounted assembly is shown in FIG. 8.

In a further embodiment having a base plate for vertical attachment, the base plate may be rotated from the vertical position. This embodiment may be used, for example, to attach a railing to an outside edge of a staircase.

A post may be used as an end post by inserting an insert and wedge into the empty channel on the outside end of the post.

Preferably, the non-panel components of the adaptable panel mounting system are manufactured of aluminum, although other materials are also possible and included within the scope of the present invention. The panels of the system are preferably tempered glass, but other materials are also within the scope of the invention.

In operation, the components of the system of the invention are readily manufactured and assembled. As the three post types will allow for a wide range of possible angles, and the base plates will allow for surface and fascia mounting, it is possible to arrive at a work site with standardized components which may be selected as necessary to fulfill the site requirements.

Panel replacement is easily achieved without disrupting other panels of the structure, as individual panels may be removed and replaced independent of other panels.

While specific dimensions of the components of the invention have been provided, other dimensions are also within the scope of the present invention.

In alternate embodiments, the technology described in the present invention may be used to assemble office dividers or other wall-like structures.

The invention claimed is:

1. A panel mounting system for mounting a linear panel structure on a surface, the system comprising:

a plurality of posts, each post having a base plate with one or more mounting surfaces for surface attachment and a vertical extension, the vertical extension having a generally T-shaped transverse cross-section comprising a lateral support beam and a panel-receiving cross beam, the lateral support beam being a solid stiffening member with a uniform thickness along the height and extending perpendicularly from the center of the panel receiving cross-beam;

the opposite ends of the cross-beam comprise a pair of opposing semi-circular channels, wherein each channel forms a channel angle of between 45 degrees and 135 degrees relative to the lateral support beam and each panel is rotatable about a vertical axis at each end through a panel angle of greater than 20 degrees to either side of the channel angle of the corresponding channels;

a hollow, circular cylindrical insert insertable into each channel; a panel mountable between each pair of adjacent posts, each end of the panel insertable into a corresponding insert; and a semi-circular wedge insertable at the top end of each semi-circular channel for securing the panel in a desired panel angle position.

2. The panel mounting system of claim 1, further comprising a setting block insertable in the lower end of each channel for supporting the corresponding panel a desired distance above the surface.

3. The panel mounting system of claim 1, further comprising one or more wall tracks mountable on a vertical surface, each wall track having a semi-circular channel at an angle of between 45 degrees and 135 degrees relative to the vertical surface.

4. The panel mounting system of claim 1, wherein the one or more mounting surfaces of the base plate are perpendicular to the longitudinal axis of the vertical extension.

5. The panel mounting system of claim 1, wherein the one or more mounting surfaces of the base plate are parallel to the longitudinal axis of the vertical extension.

6. The panel mounting system of claim 1, wherein the one or more mounting surfaces of the base plate are at a selected angle relative to the longitudinal axis of the vertical extension, the selected angle corresponding to the slope of the mounting surface.

7. The panel mounting system of claim 1, wherein each of the panels is manufactured of tempered glass.

8. The panel mounting system of claim 1, wherein each channel opening is adapted to receive a panel having a thickness of 10 mm.

9. The panel mounting system of claim 1, wherein each channel opening is adapted to receive a panel having a thickness of 12 mm.

* * * * *